US011382372B2

(12) United States Patent
Navarro et al.

(10) Patent No.: US 11,382,372 B2
(45) **Date of Patent: *Jul. 12, 2022**

(54) GARMENT FOR WATER WEIGHT-LOSS

(71) Applicants: Salvador Navarro, Los Angeles, CA (US); Stephanie Diaz-Sandoval, Los Angeles, CA (US)

(72) Inventors: Salvador Navarro, Los Angeles, CA (US); Stephanie Diaz-Sandoval, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/897,218

(22) Filed: Jun. 9, 2020

(65) Prior Publication Data

US 2020/0297048 A1 Sep. 24, 2020

Related U.S. Application Data

(63) Continuation of application No. 15/897,118, filed on Feb. 14, 2018, now Pat. No. 10,674,774.

(60) Provisional application No. 62/458,980, filed on Feb. 14, 2017.

(51) Int. Cl.

| | |
|---|---|
| ***A41D 31/00*** | (2019.01) |
| ***A41D 31/04*** | (2019.01) |
| ***A41D 13/00*** | (2006.01) |
| ***A41D 31/18*** | (2019.01) |
| *A41D 31/30* | (2019.01) |

(52) U.S. Cl.

CPC ..... *A41D 31/04* (2019.02); *A41D 13/0015* (2013.01); *A41D 31/18* (2019.02); *A41D 31/30* (2019.02); *A41D 31/305* (2019.02); *A41D 2400/10* (2013.01); *A41D 2500/54* (2013.01); *A41D 2600/10* (2013.01)

(58) Field of Classification Search

CPC .... A41D 13/0015; A41D 31/04; A41D 31/30; A41D 2400/10; A41D 2500/54; A41D 2600/10; A41D 31/18; A41D 31/305

See application file for complete search history.

(56) References Cited

U.S. PATENT DOCUMENTS

| | | | | |
|---|---|---|---|---|
| 4,946,453 | A | 8/1990 | Monson | |
| 5,182,812 | A | 2/1993 | Goldsby | |
| 5,778,452 | A | 7/1998 | Dicker et al. | |
| 7,636,950 | B2 * | 12/2009 | Melhart | A41D 13/08 2/69 |
| 8,376,808 | B2 | 2/2013 | Hopkins | |
| 8,732,862 | B1 | 5/2014 | Shields | |
| 9,332,792 | B2 * | 5/2016 | Harber | A41D 27/28 |
| 9,345,275 | B2 * | 5/2016 | Albin | A41D 31/185 |

(Continued)

OTHER PUBLICATIONS https://kuttingweight.com/collections/weight-loss?gclid=CKiCxZOvxdECFYFXfgodz2cK0Q.

*Primary Examiner* — Steven O Douglas

(57) ABSTRACT

A garment and method for targeted water weight-loss of a user. The garment may be a typical article of clothing; however, heat trapping agents are applied to the garment, particularly on the inside of the garment so as to make contact with the skin causing increased perspiration of the user at the location where the heating trapping agent contacts the skin. The heat trapping agent can be applied to the garment at desired locations and with a desired pattern to increase the efficiency of perspiration, and therefore, water weight-loss, Preferably, the heat trapping agent is print material with a stretch additive.

16 Claims, 6 Drawing Sheets

(56) References Cited

U.S. PATENT DOCUMENTS

| | | | | |
|---|---|---|---|---|
| 10,674,774 | B2 * | 6/2020 | Navarro | A41D 31/04 |
| 2003/0106129 | A1 | 6/2003 | Kim | |
| 2010/0031414 | A1 | 2/2010 | Millet | |
| 2011/0203783 | A1 | 8/2011 | Blackford et al. | |
| 2012/0210487 | A1 * | 8/2012 | Albin | A41D 1/08 2/69 |

* cited by examiner

GARMENT FOR WATER WEIGHT-LOSS

CROSS REFERENCE TO RELATED APPLICATIONS

This application is a continuation of U.S. application Ser. No. 15/897,118, filed Feb. 14, 2018 titled, "Garment for Water Weight-Loss," which claims the benefit of U.S. Patent Application No. 62/458,980 titled, "Compression Garment with Print Pattern for Water Weight-Loss and Thermoregulation" filed on Feb. 14, 2017.

FIELD OF INVENTION

The present invention relates to garments designed to cause targeted increased perspiration.

BACKGROUND ART

Various garments have suggested neoprene as a means of promoting water weight-loss through perspiration. While this may be true, neoprene-produced exercise garments are also very heavy, thick, difficult to wash, not fashionable, significantly reduces range of motion, is very uncomfortable, and sometimes contains zippers and other materials that can cause injury to the individual and/or others during physical activity.

As such, there is a need for a water weight-loss garment that is light and thin; fashionable, can be worn as a regular outfit (not underneath clothes to hide its usage); allows all bodily functions and range of motions, highly comfortable; and does not contain anything on the fabric that could potentially harm the person or others during physical activities, such as training, exorcise, play, and the like.

SUMMARY OF THE INVENTION

The present invention is a garment designed to cause targeted increased perspiration in select areas of the body to facilitate water weight-loss in an individual wearing the garment. Preferably, a user would wear the garment during physical activity, such as, but not limited to, any type of exercise or training, such as, dynamic and static strength-training, circuit training, jogging, running, cycling, and the like; and any sport, such as football, basketball, hockey, tennis, soccer, baseball, martial arts, and the like, In fact, the garment may be worn during any physical activity, including walking, gardening, and cleaning as well. This invention, however, is not intended for use during extended periods of the day nor for all-day wear. Therefore, it is important to monitor the water weight-loss intensity to ensure that dehydration is avoided when using this garment.

The garment is a combination of a fabric material and a heat trapping agent, preferably with stretch additive. The heat trapping agent is applied to select regions of the fabric material for targeted perspiration, thereby allowing one to perform low-intensity to high-intensity physical activities with a full range of motion for the attainment of water weight-loss during the use of this invention.

The intended purpose for the application of the heat trapping agent onto select regions of the inner and/or outer surface of the fabric material is to increase rapid weight-loss through depletion of water weight during physical activity in the select targeted area where the heat trapping agent is placed cm the fabric material.

The placement of the heat trapping agent on the fabric material, referred to hereafter as the print placement, is arranged to target specific areas on the body from where an individual wants to lose the majority of water weight. For example, a garment for an individual seeking to focus on his or her lower body would have a print placement targeting the lower abdomen and areas of the legs where fat predominantly concentrates, such as the outer hip area and inner thigh area.

Conversely, if one wants to focus on the upper body or any other part of the body, the print placement may be on the chest, back, arms, and/or shoulders. The flexibility of specific print placement to target specific areas of the body is infinite—there is no one way to print the garment as any placement of the heat trapping agent on any part of the body will yield water weight-loss.

The pattern of the heat trapping agent on the fabric material, referred to hereafter as the print pattern, is not limited to specific patterns but rather any pattern that can be designed to provide some type of targeted perspiration.

Overall, this garment causes users to increase water weight loss, and provides the wicking effect that ensures an individual stays dry during their sweaty activity.

DETAILED DESCRIPTION OF THE INVENTION

The detailed description set forth below in connection with the drawings included is intended as a description of presently-preferred embodiments of the invention and is not intended to represent the only forms in which the present invention may be constructed or utilized. The description sets forth functions and the sequence of steps for constructing and operating the invention in connection with the illustrated embodiments. However, it is to be understood that the same or equivalent functions and sequences may be accomplished by different embodiments that are also intended to be encompassed within the nature and scope of the invention and the claim mentioned herewith. Many modifications and variations are possible in light of the above teachings. It is intended that the scope of the invention not be limited by the detailed descriptions, but by the claims and the equivalents to the claim mentioned herewith, and to those modifications that will make themselves apparent to those of ordinary skill in the art.

Figure 1:
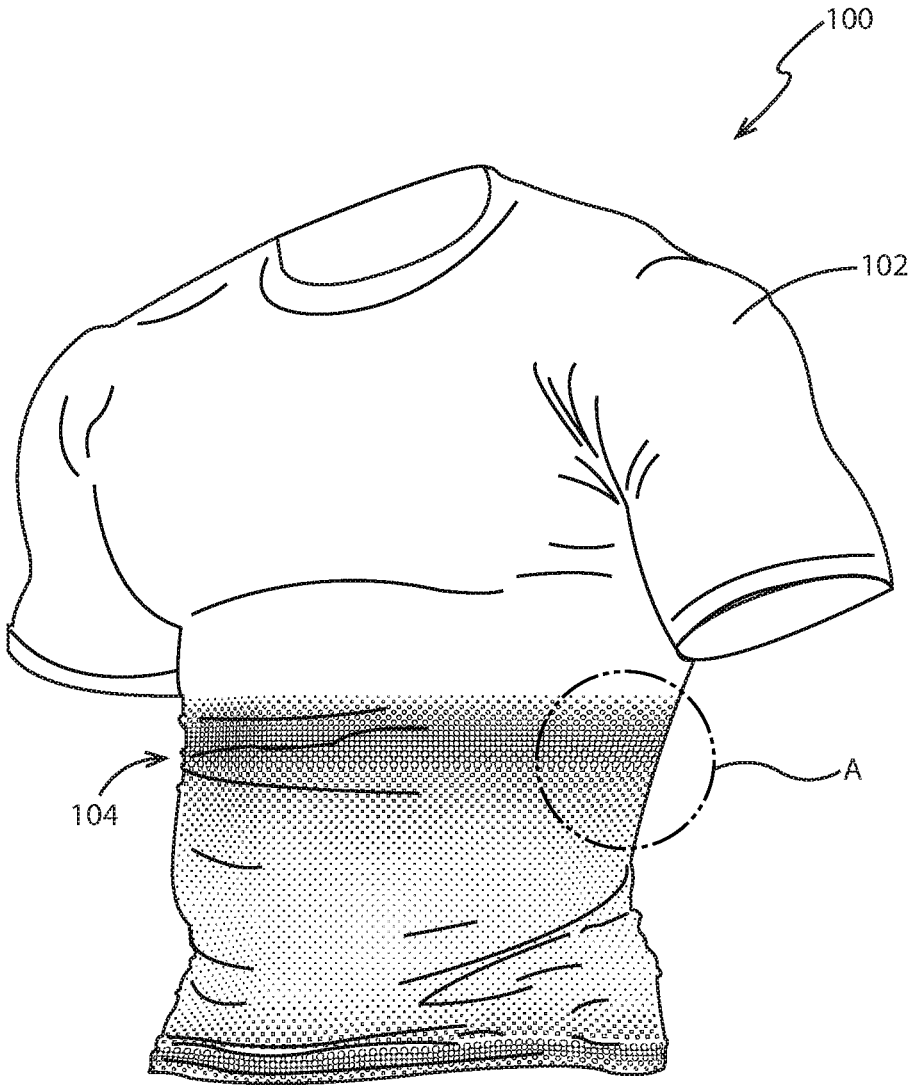
FIG. 1 depicts the front side perspective view of an embodiment of the garment.
Figure 2:
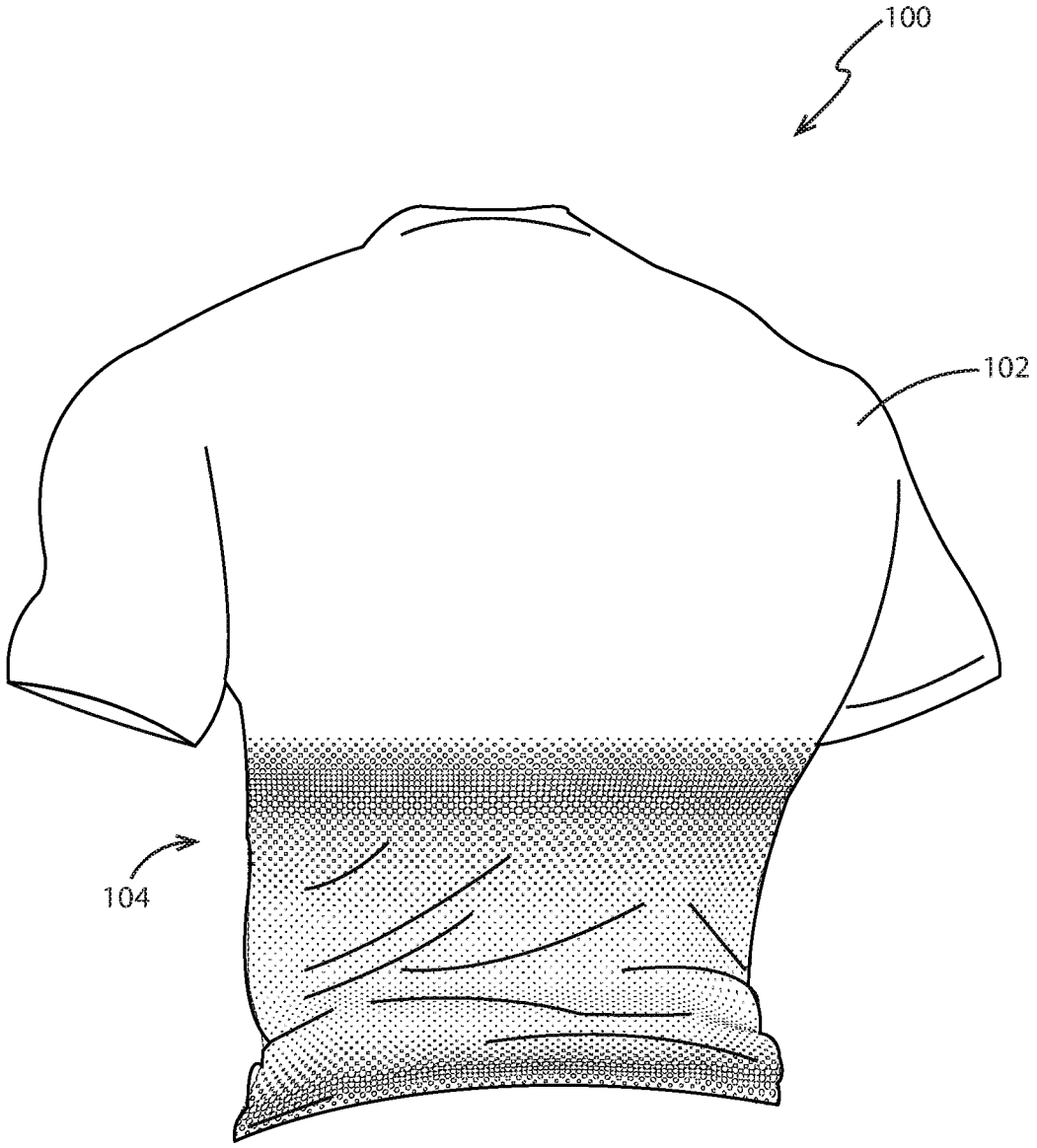
FIG. 2 depicts the back side perspective view of the garment shown in FIG. 1.
Figure 7:
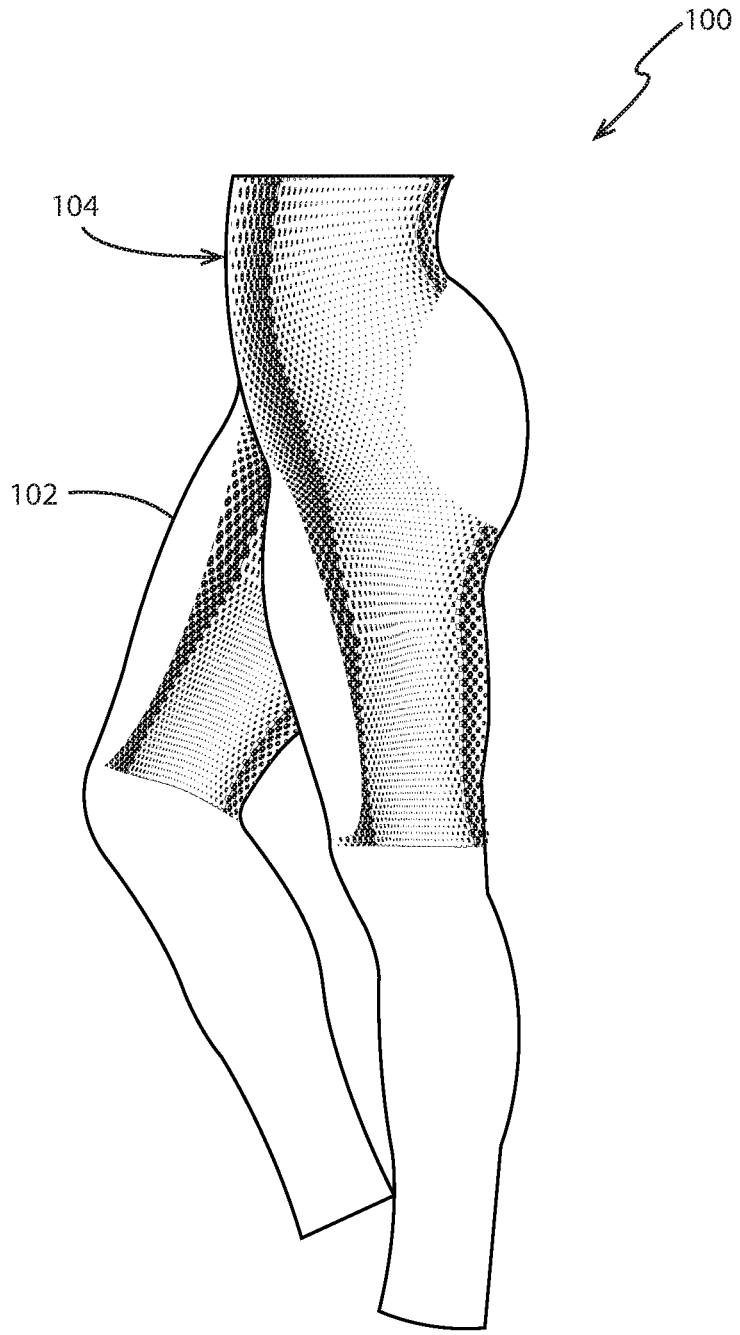
FIG. 7 is a perspective view of another embodiment of the garment.

As shown in FIGS. 1, 2, and 7, the garment 100 of the present invention may be a shirt, sweatshirt, pants, sweatpants, shorts, and any type of wear that an individual uses to wear during physical activity. The garment 100 comprises a fabric material 102 configured to be worn by the user and heat trapping agent 104 applied onto select regions of the garment 100 to target water weight loss in specific areas on the body. Therefore, it is believed the print placement, i.e. the location cm the garment 100 where the heat trapping agent 104 has been applied, determines where the weight loss takes place. The print pattern (the design of the heat trapping agent 104 on the garment 100) may affect the efficiency of the water weight loss.

The fabric material 102 may be any material used to manufacture clothing. In the preferred embodiment, the fabric material 102 may be material used in making compression clothing, such as compression shirts, compression shorts, and compression pants. For example, suitable fabric material 102 may comprise approximately 75 percent to approximately 90 percent polyester with approximately 10 percent to approximately 25 percent spandex, although the percentages may vary depending on the results an individual seeks. Therefore, the garment 100 is comfortable to wear and offers flexibility, elasticity, and breathability. In some embodiments, the fabric material 102 may comprise of approximately 70 percent to approximately 90 percent nylon with approximately 10 percent to approximately 30 percent spandex, although various combinations of the synthetic fibers can produce the fabric material 102 for the present invention.

The garment 100 is a compression garment, it is comfortable to wear, and may allow for full range of motion with stability, and may support joints and muscles. The compression garment is lightweight, comfortable, fashionable and can be worn on its own or under a different garment. In addition, it is not noticeable to the general public that an individual wearing the product is aiming for weight-loss. Rather, this invention may have the look of a regular athletic garment. Moreover, the garment 100 may be made of anti-microbial fabric which eliminates odors. The fabric material 102 making up the garment 100 may also be non-absorbent and air wicking, allowing sweat to evaporate almost instantly. The garment 100 may also be easy to wash with a simple rinse and hang dry, and easy to wear and take off.

This invention is safe and allows free range of motion, keeps the user cool in the heat and warm in cold temperatures, and allows for weight loss by sweating during workouts, thereby losing water weight in the body.

Therefore, this invention is not like a sauna suit in which it is obvious that the wearer is attempting to lose water weight fast. Also, sauna suits are heavy and uncomfortable, not fashionable, retain odor and are not washed like a regular garment.

With reference to FIGS. 3-6, the heat trapping agent 104 may comprise any print material that is used to print text, art, designs, logos, pictures, and the like onto the fabric material 102, such as ink, paint, and the like. For example, the print material may comprise plastisol screen printing ink. In the preferred embodiment, the print material may be a clear ink. Clear ink is clear and free from any color that may have added chemicals. More preferably, the print material may be a safe, non-phthalate, clear plastisol paint. Therefore, this creates the layer of print pattern that allows the individual to lose water weight. For example, the print material may comprise of plastisol screen priming ink mode from the combination of PVC resin and plasticizer. Heat trapping material can also include other material that can trap hem against the body and adhere to the fabric material 102.

The heat trapping agent 104 may further comprise a stretch additive. The stretch additive allows the print material to have flexibility, elongation, and elasticity so as to be able to stretch with the fabric material 102 during physical activity without cracking, peeling, or losing range of motion. By way of example only, the stretch additive may comprise a clear liquid substance, which may be then mixed in with the print material. Once cured, the stretch additive becomes a rubberized substance.

In the preferred embodiment, the heat trapping agent 104 may comprise approximately 2:1 ratio by volume of print material to stretch additive. In some embodiments, the heat trapping agent 104 may comprise an approximately 3:1 ratio by weight of the print material to the stretch additive.

In other embodiments, the print material may solely comprise of stretch additive only or an amount of approximately 51 percent to 99 percent stretch additive and approximately one percent to 49 percent heat trapping agent 104.

The print placement of the heat trapping agent 104 on the garment 100 is arranged to target specific areas of the body to increase the rate of perspiration in that, area of the body. Without being bound by theory, it is believed that when the heat trapping agent 104 is placed adjacent to the body, the heat trapping agent 104 traps the heat emitted front the body at that location. Trapping the heat increases the perspiration in that particular area of the body, which in turn increases the water weight-loss at that area. With reference to FIGS. 1 and 2, one of the primary targets for weight loss is the stomach and waist area. In this example, the garment 100 is a shirt. As such, the print placement for this garment 100 may be on the lower half from the bottom hem to about mid-way up the garment 100 and surrounding the entire area therebetween. Preferably, the print placement is on the inside of the garment 100 so that the heat trapping agent 104 actually touches the skin of the user. Therefore, in this example, the heat trapping agent 104 makes contact with the abdominal region, the external oblique regions of the waist, to the lumbar region in the back.

Having the heat trapping agent 104 on the inside of the garment 100 improves the efficiency of water weight-loss as the direct contact with the skin is believed to cause increased sweating compared to not having the heat trapping agent 104 make direct contact with the skin when the heat trapping agent 104 is on the outside of the garment 100, which places the fabric material 102 in between the heat trapping agent 104 and the skin. Another advantage of having the heat trapping agent 104 on the inside is that the heat trapping agent 104 is hidden. In general, when the heat trapping agent 104 is applied to the fabric material, the heat trapping agent 104 will be noticeable as some kind of design or pattern. Therefore, in the event that a preferred print pattern (as discussed below) is aesthetically not pleasing, it will remain hidden. In addition, when worn with the heat trapping agent 104 contacting the skin, the individual will experience less sliding around of the garment 100 due to the grip against the skin, thereby retaining heat for colder weather or while in water. The garment, however, still has the ability for wicking and/or evaporation of sweat.

However, while these results will still occur if worn with the heat trapping agent 104 on the outside, it will happen at a more moderate rate. When the individual wears the garment 100 with the heat trapping agent 104 on the outside, the garment 100 will be lighter and dryer due to the sweat evaporating through the fabric faster. The garment will have a more cooling effect, more range of motion by allowing the fabric material 102 to slide around without the heat trapping material 104 contacting the skin, and can be considered more comfortable to those with sensitive skin. Therefore, the print placement can also be placed on the outside of the garment 100 so that the heat trapping agent 104 does no make contact with the skin of the user.

Aside from the print placement, the print pattern can improve the efficiency of the water weight-loss. The print placement and print pattern can be combined to further achieve targeted perspiration for optimal water weight-loss achievement. The print patterns have been designed to keep the skin constantly sweating and cooling during physical activity. There are different patterns to achieve such effective water weight-loss.

Figure 6:
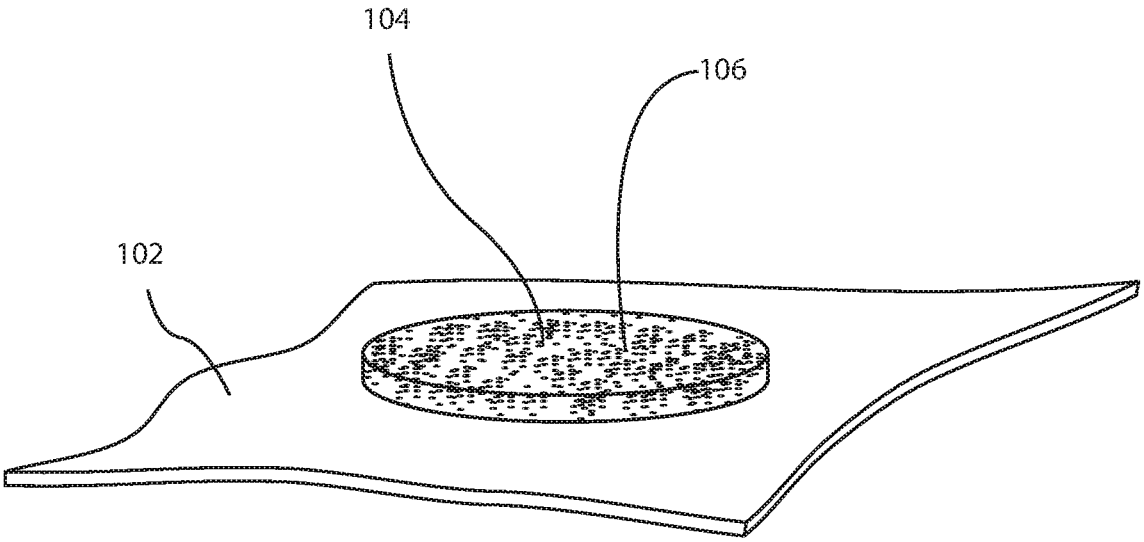
FIG. 6 is a perspective view of heat trapping agent applied to fabric material.

The print pattern is defined by deposits 106 of the heat trapping agent 104 on the fabric material 102. In some embodiments, a gradient and/or halftone pattern of deposits 106 yields a constant water weight-loss and thermoregulation. For example, most deposits 106 in this invention are made up of simple dots, lines, or individual shapes as shown in FIG. 6. The deposits 106 may start off small in certain areas of the garment 100 and gradually increase in size or vice versa which fade in or out to define the print pattern.

The spacing between the deposits 106 on the garment 100 determines the intensity of the perspiration that one will experience. Tightly spaced print pattern with smaller deposits will result in more perspiration than a garment with bigger deposits that are spaciously printed throughout the garment.

The size of each deposit 106 (e.g., diameter of a dot or thickness of a line) is important because it allows the skin to either be covered by the heat trapping agent 104 to produce sweat or uncovered by the heat trapping agent 104 to allow sweat to wick away and dry up. If the size of the deposit 106 is larger, it will cover more of the skin's surface area and increase sweating, but if the size is smaller, it will cover less of the skin's surface area, allowing sweat to evaporate through the fabric and keep the body cool. Therefore, the proper print pattern can improve the rate of perspiration. In combination with the print placement, high levels of perspiration at targeted locations can be achieved.

For example, in some embodiments, the print pattern may be placed on the garment in areas of fat concentration such as the core of the body where the size of the deposits 106 may be larger on the sides of the core and may gradually get smaller closer to the spine where less fat is stored, thus creating a gradient of large to deposits to small deposits moving from lateral portion of the garment to the central portion of the garment.

In other embodiments, the print pattern may be placed on the outer and inner thighs of the garment where fat is predominantly concentrated.

To manufacture a garment 100 of the present invention, fabric material 102 is acquired. Examples of a suitable fabric material 102 for the garment 100 include, but are not limited to, material used to manufacture t-shirts, short, leggings, undergarments, compression shirts, compression shorts, and the like. The heat trapping agent 104 is made by combining the plastisol ink and stretch additive by approximately 2:1 ratio by volume of ink to additive or approximately 3:1 ratio by weight of ink to additive. Another combination is one of approximately 51 percent to 99 percent stretch additive and approximately one percent to 49 percent heat trapping agent 104. The heat trapping agent 104 can be hand deposited onto the fabric material 102 in the desired print pattern.

In the preferred embodiment, a screen with the desired print pattern may be used, such as a silk screen used its printing on a t-shirt. The fabric material 102 is placed under the screen. The heat trapping agent 104 may be poured onto the silk screen. A squeegee may be used to pass the heat trapping agent 104 across the screen. Some of the heat trapping agent 104 passes through the screen at the designated permeable locations on the screen, thereby depositing the heat trapping agent 104 onto the fabric material 102 in the predetermined print pattern.

The heat trapping agent 104 may then be cured at a certain temperature to achieve a solidified, non-removable print on the fabric material 102 that can withstand wear and tear, washing, and light drying. The print pattern may be cured between approximately 350 degrees Fahrenheit and approximately 450 degrees Fahrenheit for about 30 seconds to about two minutes in a conveyor dryer, depending on the thickness and amount of the ink and stretch additive applied. Preferably, the print pattern is dried between approximately 410 degrees Fahrenheit to approximately 430 degrees Fahrenheit for about 30 seconds to about 60 seconds.

This invention is not intended to portray a supplement to physical activity; rather, it is a tool that can aide people with temporary water weight-loss if seeking to reduce their weight through some depletion of water weight by perspiration.

The print pattern is designed and placed on the fabric material 102 with the intention of causing the most amount of perspiration to the areas of most common fat storage. For example, the print pattern may become most dense on the portion of the garment 100 that comes into contact with the area of the body where fat storage is most common when the garment is worn properly; and density of the print pattern may gradually decrease towards areas of the garment 100 that contact areas of the body with less fat storage. In other words, where there is more fat storage on the body, the corresponding portion of the garment 100 will be covered and printed on most with the print material, and where there is less fat storage, the corresponding portion of the garment 100 will be less printed and less covered and more exposed allowing less heat to be trapped in and allowing cooling to occur.

FIGS. 1 and 2 show a changing gradient of print pattern in which the print pattern becomes more dense as it moves lower down the garment.

Figure 3:
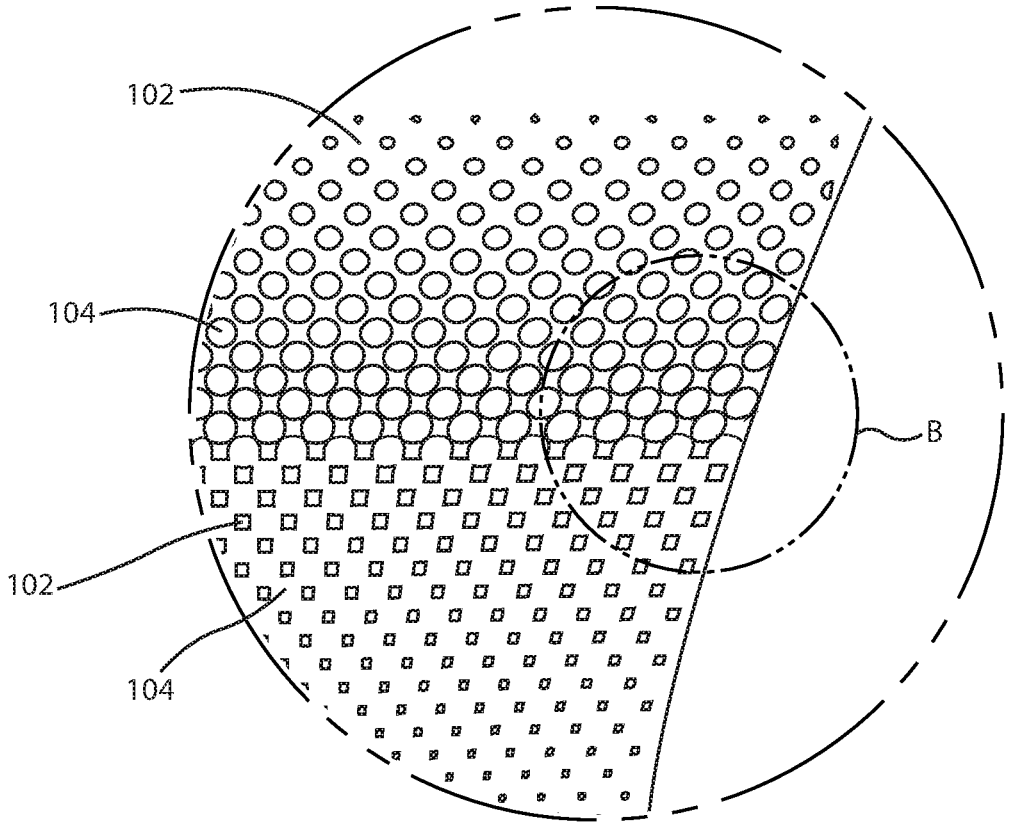
FIG. 3 is a close up of the garment shown in FIG. 1 of the area of the garment designated as A.
Figure 4:
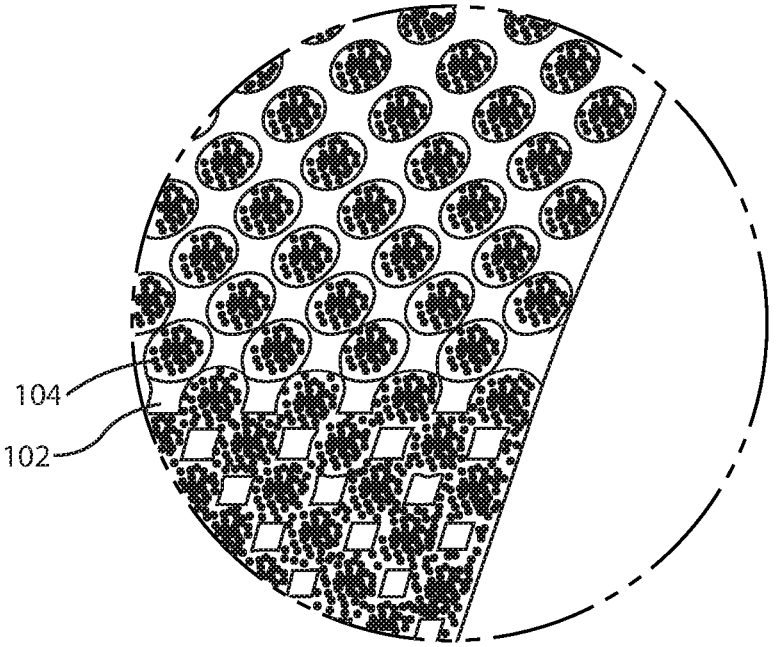
FIG. 4 is a close up of the area shown in FIG. 3 designated as B.
Figure 5:
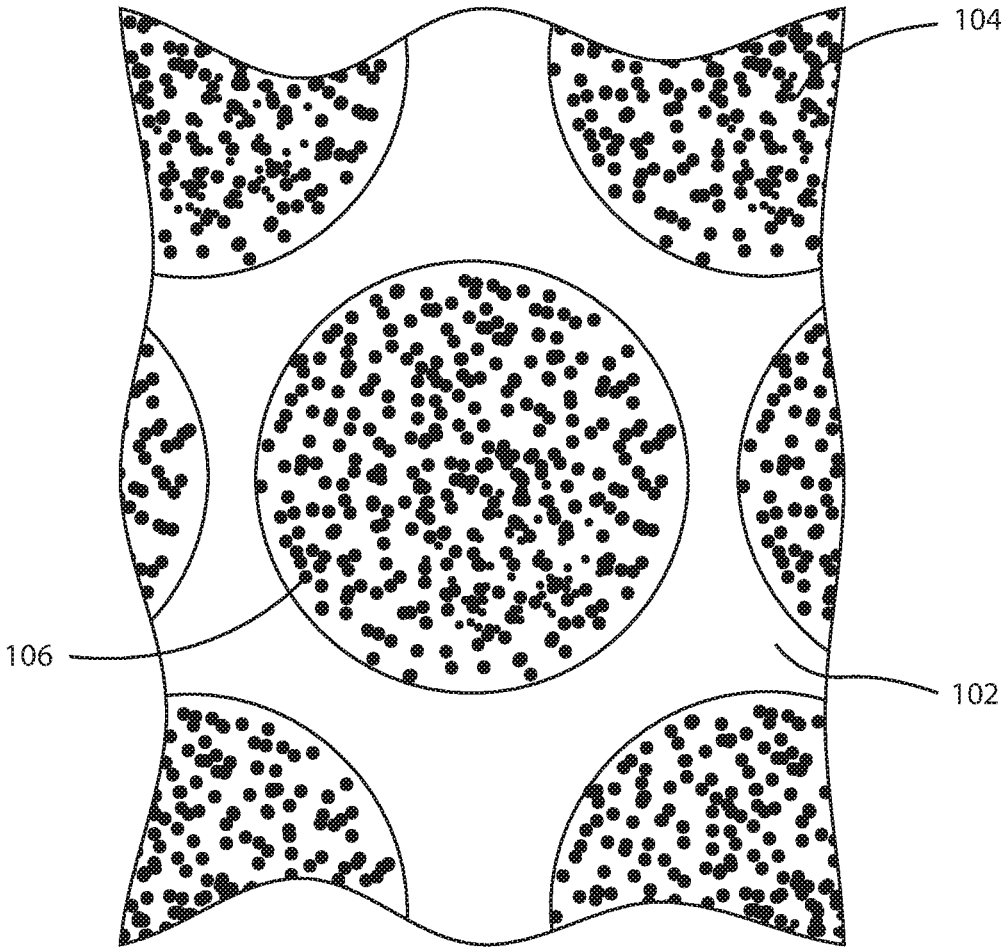
FIG. 5 is a close up view of one of the circle print patterns on the fabric illustrated in FIG. 4.

FIGS. 3 and 4 show a close up of the garment to illustrate the differences in density of the print pattern. The circled pattern of deposited material higher up is more spaced out and do not touch one another. This is the area of less fat storage and allows less heat to be trapped. As shown in FIG. 4, on the middle of the pattern, the deposits 106 begin to get closer and closer together mail they finally touch. Once the deposits 106 get close together, more of the garment's surface area is covered up by the heat trapping agent 104, but still leaving small vents of fabric material 102 seen as squares to wick away excess sweat.

FIG. 6 depicts one individual deposit 106 of heat trapping agent 104 on the fabric material 102. The part of the fabric material 102 surrounding the deposit 106 may be the area of less fat storage due to no other deposit surrounding this particular individual deposit for the purpose of illustrating how the print pops up above the fabric.

In use, a user desiring to lose water weight selects a garment 100 having a print pattern that matches the area of his or her body from which he or she desires to lose water weight. For example, if the user desires to lose water weight around the waist and stomach area, the user would select a garment 100 with a print pattern in which high density of print material is deposited around the stomach and waist. If the user desires to lose water weight around the thighs, then he or she would select a garment 100 with a high density of print material deposited around the thighs. If the user desires to lose water weight around the buttocks, the user would select a garment 100 with a high density of print material deposited around the buttocks.

Once the user has selected the garment 100 with the proper print pattern of the heat trapping agent 104, the user dons the garment 100. The heat trapping agent 104 may contact the area of the body where the water weight is desired to be lost if the heat trapping agent 104 is on the inside. If the heat trapping agent 104 is on the outside, then the heat trapping agent 104 is simply adjacent to the area of the body where the water weight is desired to be lost.

Once the garment 100 is donned properly, the user simply engages in a physical activity, such as an exercise routine, or playing a sport. The areas of the body adjacent to or making contact with the beat trapping agent 104 heat up faster than other areas and perspire more than other areas thereby losing water weight in that area.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A garment for facilitating loss of water weight, the garment comprising:

a) a fabric material configured to be worn by a user; and b) a heat trapping agent having a print placement and a print pattern applied onto select regions of the fabric material to target water weight loss in specific areas on the user, wherein the heat trapping agent comprises a print material, wherein the print material comprises a stretch additive configured to increase elasticity of the print material after being cured and thus increasing the elasticity of the fabric material at the select regions.

2. The garment of claim 1, wherein the print placement of the heat trapping agent on the fabric material is arranged to target specific areas of the body to increase the rate of perspiration in that area of the body.

3. The garment of claim 1, wherein the print placement is on an inside of the garment.

4. The garment of claim 1, wherein the print pattern comprises a high density print pattern in which the print material is continuous, gradually transitioning to a low density print pattern comprising a plurality of discrete print material.

5. The garment of claim 1, wherein the fabric material comprises approximately 75 percent to approximately 90 percent polyester; and approximately 10 percent to approximately 25 percent spandex.

6. A method of losing water weight, comprising:

a) donning a garment for facilitating loss of water weight, the garment comprising:

i) a fabric material configured to be worn by a user, and ii) a heat trapping agent having a print placement and a print pattern applied onto select regions of the fabric material to target water weight loss in specific areas on the user; and b) engaging in physical activity wherein the heat trapping agent comprises a print material, wherein the print material comprises a stretch additive configured to increase elasticity of the print material after being cured and thus increasing the elasticity of the fabric material at the select regions.

7. The method of claim 6, wherein the print placement of the heat trapping agent on the garment is arranged to target specific areas of the body to increase the rate of perspiration in that area of the body.

8. The method of claim 6, wherein the print placement is on an inside of the garment.

9. The method of claim 6, wherein the print pattern comprises a high density print pattern that is continuous transitioning to a low density print pattern that contains a plurality of discrete print material.

10. The method of claim 6, wherein the fabric material comprises approximately 75 percent to approximately 90 percent polyester; and approximately 10 percent to approximately 25 percent spandex.

11. The garment of claim 1, wherein the print material is selected from the group consisting of ink and paint.

12. The garment of claim 1, wherein the print material is ink.

13. The garment of claim 1, wherein the print material is paint.

14. The method of claim 6, wherein the print material is selected from the group consisting of ink and paint.

15. The method of claim 6, wherein the print material is ink.

16. The method of claim 6, wherein the print material is paint.

* * * * *